US010041200B2

(12) United States Patent
Okuda et al.

(10) Patent No.: US 10,041,200 B2
(45) Date of Patent: Aug. 7, 2018

(54) BULKINESS RECOVERY APPARATUS AND BULKINESS RECOVERY METHOD FOR NONWOVEN FABRIC

(71) Applicant: UNICHARM Corporation, Ehime (JP)

(72) Inventors: Jun Okuda, Kagawa (JP); Satoshi Mitsuno, Kagawa (JP)

(73) Assignee: UNICHARM CORPORATION, Ehime (JP)

( * ) Notice: Subject to any disclaimer, the term of this patent is extended or adjusted under 35 U.S.C. 154(b) by 11 days.

(21) Appl. No.: 15/028,935

(22) PCT Filed: Sep. 25, 2014

(86) PCT No.: PCT/JP2014/075484

§ 371 (c)(1),
(2) Date: Apr. 12, 2016

(87) PCT Pub. No.: WO2015/056543

PCT Pub. Date: Apr. 23, 2015

(65) Prior Publication Data

US 2016/0244903 A1 Aug. 25, 2016

(30) Foreign Application Priority Data

Oct. 18, 2013 (JP) ..... 2013-217198

(51) Int. Cl.
*D06C 7/00* (2006.01)
*D06B 5/08* (2006.01)
(Continued)

(52) U.S. Cl.
CPC ..... *D06C 7/00* (2013.01); *D04H 1/70* (2013.01); *D06B 5/08* (2013.01); *D06C 3/00* (2013.01)

(58) Field of Classification Search
CPC ... D06C 3/00; D06C 3/06; D06C 7/00; D06C 7/02; D06C 2700/09; D06C 2700/13;
(Continued)

(56) References Cited

U.S. PATENT DOCUMENTS 1,470,306 A * 10/1923 Walsh ..... D06C 7/00 34/203
1,605,039 A * 11/1926 Krantz ..... D06C 7/00 26/92

(Continued)

FOREIGN PATENT DOCUMENTS

JP 2004-137655 A 5/2004
JP 2009-155756 A 7/2009

(Continued)

OTHER PUBLICATIONS

Written Opinion in International Patent Application No. PCT/JP2014/075484, dated Dec. 22, 2014.

(Continued)

*Primary Examiner* — Amy Vanatta
(74) *Attorney, Agent, or Firm* — Hauptman Ham, LLP

(57) ABSTRACT

A bulkiness recovery apparatus for nonwoven fabric, the apparatus being for recovering bulkiness of the nonwoven fabric by blowing hot air to heat the nonwoven fabric, the apparatus including: a heating mechanism including case units, jet inlets and an evacuation opening, the case unit having a conveyor space in which the nonwoven fabric is conveyed, the jet inlet blasting hot air into the conveyor space from a one side toward another side of the conveyor space in a conveying direction of the nonwoven fabric, the evacuation opening evacuating hot air from the conveyor space, the hot air flowing along the conveying direction while being in contact with either one of two surfaces of the nonwoven fabric; and deformation mechanisms that deform (Continued)

the nonwoven fabric discharged from the case unit so that the one surface of the nonwoven fabric is convex.

15 Claims, 5 Drawing Sheets

(51) Int. Cl.
*D06C 3/00* (2006.01)
*D04H 1/70* (2012.01)

(58) Field of Classification Search
CPC .. F26B 3/04; F26B 13/06; F26B 13/08; F26B 13/005; F26B 13/108; F26B 13/12; F26B 3/10; F26B 21/00; F26B 13/103; F26B 13/104; F26B 21/06; D06B 1/02; D06B 1/08; D06B 3/12; D06B 3/20; D06B 3/28; D06B 5/08; D06B 5/02; D06B 21/00; C21D 9/52; C21D 9/54; C21D 9/56; C21D 9/563; C21D 9/564; C21D 9/567; C21D 9/63; F27B 9/023; F27B 9/024; F27B 9/10; F27B 9/145; F27B 9/28; D04H 1/50
USPC ..... 28/167; 26/106; 68/5 D, 5 E; 34/580, 34/590, 620, 636
See application file for complete search history.

(56) References Cited

U.S. PATENT DOCUMENTS 1,670,991 A * 5/1928 Schilde ..... D06C 7/00 34/223
1,710,843 A * 4/1929 Schnitzler ..... F26B 13/06 26/92
2,101,335 A * 12/1937 Jennings ..... F26B 3/283 34/421
2,494,731 A * 1/1950 Vincent ..... D06C 7/00 198/606
2,700,226 A * 1/1955 Dungler ..... D06C 7/00 34/656
3,231,985 A * 2/1966 Smith, Jr. ..... F26B 3/283 34/448
3,510,954 A * 5/1970 Dunn, Jr. ..... B29C 71/00 34/444
3,852,980 A * 12/1974 Zimmer ..... B41F 23/0426 101/118
4,052,796 A * 10/1977 Arendt ..... D06C 7/00 34/60
4,124,941 A * 11/1978 Birke ..... F26B 13/08 34/114
4,952,145 A * 8/1990 Kwiatkowski ..... B29C 35/06 126/92 AC
5,471,766 A * 12/1995 Heikkila ..... F26B 13/104 34/461
5,908,290 A * 6/1999 Kawamura ..... D01D 10/0436 34/636
6,006,446 A * 12/1999 Pagendarm ..... F26B 13/104 34/633
7,004,753 B2 * 2/2006 Stockhausen ..... D01F 9/32 34/444
9,303,921 B2 * 4/2016 Berner ..... D01F 9/32
2004/0111848 A1 * 6/2004 Miyamoto ..... A61F 13/15699 28/165
2011/0191994 A1 * 8/2011 Takahashi ..... D04H 1/498 28/167
2015/0211157 A1 * 7/2015 Okuda ..... D04H 3/04 442/334
2015/0299909 A1 * 10/2015 Mizuno ..... D01F 9/32 432/8

FOREIGN PATENT DOCUMENTS

WO 2010/047292 A1 4/2010
WO 2013/157611 A1 10/2013

OTHER PUBLICATIONS

International Search Report in PCT/JP2014/075484, dated Dec. 22, 2014.

* cited by examiner

BULKINESS RECOVERY APPARATUS AND BULKINESS RECOVERY METHOD FOR NONWOVEN FABRIC

RELATED APPLICATIONS

The present application is a National Phase entry of International Application No. PCT/JP2014/075484, filed Sep. 25, 2014, which claims priority of Japanese Application No. 2013-217198, filed Oct. 18, 2013.

TECHNICAL FIELD

The invention relates to a bulkiness recovery apparatus for nonwoven fabric and a bulkiness recovery method for nonwoven fabric.

BACKGROUND ART

Generally, nonwoven fabric, after manufacturing, is wound in rolls to be stored in a form of a web roll of nonwoven fabric. Thereafter, in another process, the nonwoven fabric is fed out from the web roll and used. At the time of winding the nonwoven fabric, the nonwoven fabric is subject to tension. Consequently, the nonwoven fabric which has been wound is compressed in the thickness direction and its bulkiness decreases. For this reason, the method being for recovering bulkiness of the nonwoven fabric has been proposed in which hot air is blown to the surface of nonwoven fabric in the a direction normal to the surface to heat the nonwoven fabric (see [Patent Literature 1], for example).

CITATION LIST

Patent Literature

[Patent Literature 1] Japanese Unexamined Patent Application Publication No. 2004-137655

SUMMARY OF INVENTION

Technical Problem

However, in the method of [Patent Literature 1], hot air is blown in the opposite direction to the direction in which the bulkiness of nonwoven fabric recovers. This may lower an effect in bulkiness recovery by heating the nonwoven fabric. In addition, on the surface of the nonwoven fabric onto which hot air is blown, this may cause fusing of fiber constituting the nonwoven fabric (the fusing narrows space between fibers), and this also may decrease bulkiness recovery effect, which is achieved by heating nonwoven fabric.

The invention has been made in view of the above conventional problems, and an advantage thereof is to prevent decrease of bulkiness recovery effect, which is achieved by heating of nonwoven fabric.

Solution to Problem

An aspect of the invention to achieve the above advantage is a bulkiness recovery apparatus for nonwoven fabric, the apparatus being for recovering bulkiness of the nonwoven fabric by blowing hot air to heat the nonwoven fabric, the apparatus including: a heating mechanism including a case unit, a jet inlet and an evacuation opening, the case unit having a conveyor space in which the nonwoven fabric is conveyed, the jet inlet blasting hot air into the conveyor space from a one side toward another side of the conveyor space in a conveying direction of the nonwoven fabric, the evacuation opening evacuating hot air from the conveyor space, the hot air flowing along the conveying direction while being in contact with either one of two surfaces of the nonwoven fabric; and a deformation mechanism that deforms the nonwoven fabric discharged from the case unit so that the one surface of the nonwoven fabric is convex.

Other features of this invention will become apparent from the description in this specification and the attached drawings.

Advantageous Effects of Invention

With a bulkiness recovery apparatus for nonwoven fabric and a bulkiness recovery method for nonwoven fabric according to the invention, it is possible to prevent decrease of bulkiness recovery effect, which is achieved by heating of nonwoven fabric.

DESCRIPTION OF EMBODIMENTS

Figure 1A:
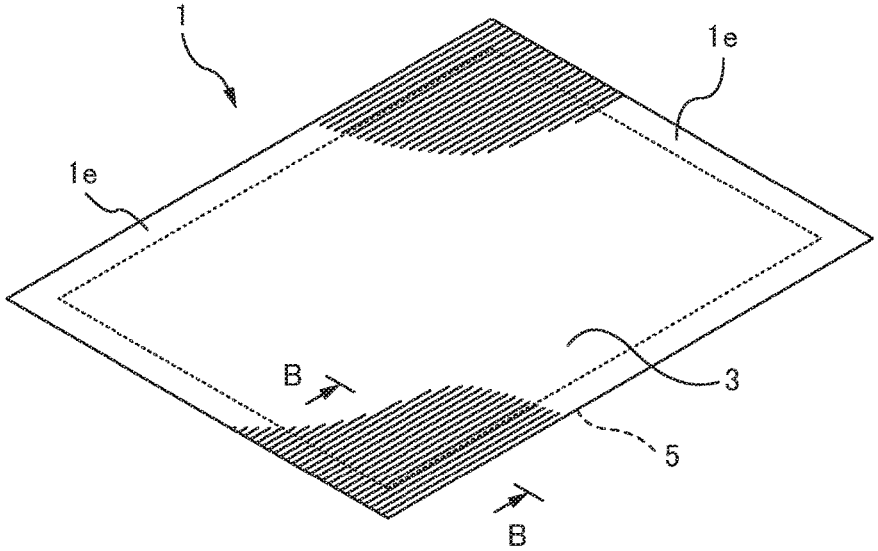
FIG. 1A is a perspective view of a pet pad.

At least the following matters will become apparent from the descriptions in the specification and the accompanying drawings.

A bulkiness recovery apparatus for nonwoven fabric, the apparatus being for recovering bulkiness of the nonwoven fabric by blowing hot air to heat the nonwoven fabric, the apparatus including: a heating mechanism including a case unit, a jet inlet and an evacuation opening, the case unit having a conveyor space in which the nonwoven fabric is conveyed, the jet inlet blasting hot air into the conveyor space from a one side toward another side of the conveyor space in a conveying direction in which the nonwoven fabric is conveyed inside the conveyor space, the evacuation opening evacuating hot air from the conveyor space, the hot air flowing along the conveying direction while being in contact with either one of two surfaces of the nonwoven fabric; and a deformation mechanism that deforms the nonwoven fabric discharged from the case unit so that the one surface of the nonwoven fabric is convex.

With such a bulkiness recovery apparatus for nonwoven fabric, since hot air flows along the conveying direction of the nonwoven fabric, it is possible to prevent decrease of bulkiness recovery effect of the nonwoven fabric (if hot air is blown to any surface of the nonwoven fabric in the direction normal to the surface, the effect will decrease). Further, the nonwoven fabric is deformed so that a side of the surface of the nonwoven fabric to which hot air has been blown is convex; and as a result, fused fibers on the side of the surface of the nonwoven fabric are loosened to widen interfiber space. This also makes it possible to prevent decrease of bulkiness recovery effect of the nonwoven fabric. Furthermore, loosening fused fibers on the side of the surface of the nonwoven fabric makes it possible to soften one surface of the nonwoven fabric.

In such a bulkiness recovery apparatus for nonwoven fabric, the deformation mechanism deforms the nonwoven fabric that is being spontaneously cooled outside the case unit.

With such a bulkiness recovery apparatus for nonwoven fabric, it is possible to prevent the nonwoven fabric from having deformation tendency. Fibers that are being spontaneously cooled are more likely to be loosened by deformation of the nonwoven fabric, compared to fibers which have been heated and softened and become easy to stretch. Accordingly, deforming nonwoven fabric that is being spontaneously cooled makes it possible to more reliably loosen fused fibers on the side of the surface of the nonwoven fabric. And, this also makes it possible to prevent decrease of bulkiness recovery effect of the nonwoven fabric.

In such a bulkiness recovery apparatus for nonwoven fabric, the deformation mechanism is a conveying roller that conveys the nonwoven fabric by winding the nonwoven fabric around the conveying roller.

With such a bulkiness recovery apparatus for nonwoven fabric, it is possible to prevent increase in the number of components, compared to a case in which a deformation mechanism, which is not a conveying roller, is provided.

In such a bulkiness recovery apparatus for nonwoven fabric, the nonwoven fabric that has passed the deformation mechanism is reheated by another heating mechanism.

With such a bulkiness recovery apparatus for nonwoven fabric, when reheating the nonwoven fabric, hot air is flowing along the conveying direction while being in contact with one surface of the nonwoven fabric which has been loosened by the deformation mechanism. This makes it possible to increase the efficiency of heating nonwoven fabric.

In such a bulkiness recovery apparatus for nonwoven fabric, the conveyor space of the heating mechanism and a conveyor space of another heating mechanism are aligned in a direction intersecting the conveying direction in which the nonwoven fabric is conveyed inside the conveyor space, and the deformation mechanism is a conveying roller which reverses the nonwoven fabric while conveying the nonwoven fabric by winding the nonwoven fabric around the conveying roller, the conveying roller performing the reversing in order to supply the conveyor space of the other heating mechanism with the nonwoven fabric that has passed the conveyor space of the heating mechanism.

With such a bulkiness recovery apparatus for nonwoven fabric, it is possible to reduce the length of the heating mechanism in the conveying direction of the nonwoven fabric. Consequently, the heating mechanism can be downsized. And, reversing the nonwoven fabric by the conveying roller increases the degree of deformation (degree of curving) of the nonwoven fabric. This makes it possible to more reliably loosen fused fibers on the side of the surface of nonwoven fabric, and also possible to prevent decrease of bulkiness recovery effect of the nonwoven fabric.

A bulkiness recovery method for nonwoven fabric, the method being for recovering bulkiness of the nonwoven fabric by blowing hot air to heat the nonwoven fabric, the method including: heating the nonwoven fabric by a process including blasting hot air into a conveyor space of the nonwoven fabric from a one side toward another side of the conveyor space in a conveying direction in which the nonwoven fabric is conveyed inside the conveyor space, the conveyor space being formed in a case unit, and flowing the hot air along the conveying direction while being in contact with either one of two surfaces of the nonwoven fabric; and deforming the nonwoven fabric discharged from the case unit so that the one surface of the nonwoven fabric is convex.

With such a bulkiness recovery method for nonwoven fabric, since hot air flows along the conveying direction of the nonwoven fabric, it is possible to prevent decrease of bulkiness recovery effect of the nonwoven fabric (if hot air is blown to a surface of the nonwoven fabric in the direction normal to the surface, the effect will decrease). Further, the nonwoven fabric is deformed so that a side of the surface of the nonwoven fabric to which hot air has been blown is convex; and as a result, fused fibers on the side of the surface of the nonwoven fabric are loosened to widen interfiber space. This also makes it possible to prevent decrease of bulkiness recovery effect of the nonwoven fabric. Furthermore, loosening fused fibers on the side of the surface of the nonwoven fabric makes it possible to soften one surface of the nonwoven fabric.

== Pet Pad 1 ==

Figure 1B:
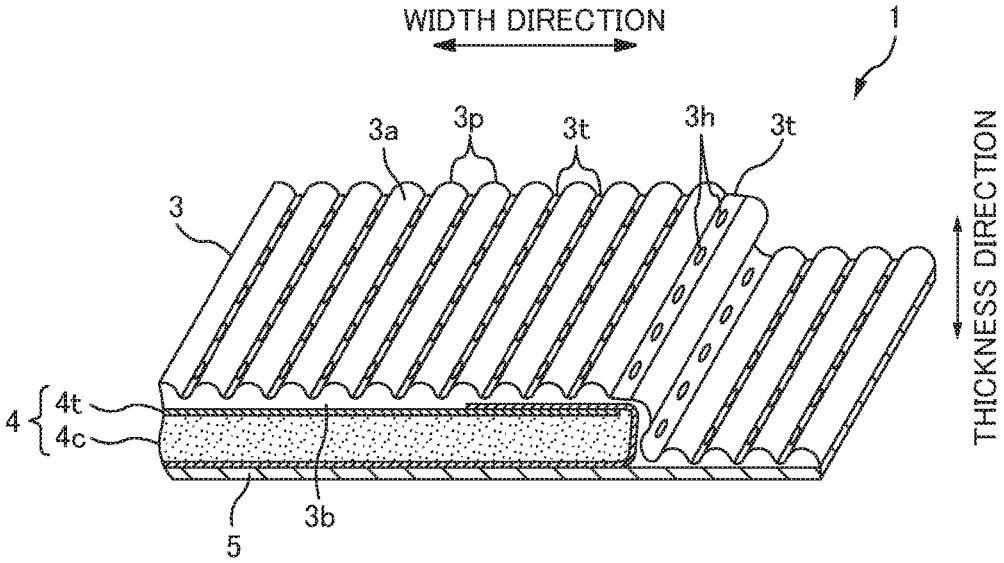
FIG. 1B is a cross sectional view of the pet pad taken along line B-B in FIG. 1A.

FIG. 1A is a perspective view of a pet pad 1, and FIG. 1B is a cross sectional view of the pet pad 1 taken along line B-B in FIG. 1A. Nonwoven fabric the bulkiness of which has been recovered by a bulkiness recovery apparatus for nonwoven fabric according to the invention (to be described later) is used as a top sheet 3 of the pet pad 1 and the like. The pet pad 1 is placed on a floor or the like to be used for disposing of animal excrement, and includes: a liquid-permeable top sheet 3 having a rectangular shape when viewed from above; a liquid-impermeable back sheet 5 having substantially the same shape as the top sheet 3; and a liquid-absorbent absorbent body 4 placed between the sheets 3 and 5, for example.

The top sheet 3, the absorbent body 4 and the back sheet 5 are joined to one another with hot-melt adhesive, etc. In the edge 1*e* of the pet pad 1 in which the absorbent body 4 does not exist, the top sheet 3 and the back sheet 5 are joined with hot-melt adhesive, etc.

The absorbent body 4 is, for example, a thing made by covering an absorbent core 4*c* with a liquid-permeable cover sheet 4*t* (e.g. tissue paper), the absorbent core 4*c* being made by applying super absorbent polymer (so-called SAP) to liquid absorbent fiber (e.g. pulp fiber). And the back sheet 5 is, for example, film made of material such as polyethylene (PE), polypropylene (PP), polyethylene terephthalate (PET), or the like.

As an example of the top sheet 3, a nonwoven fabric 3 is used, as shown in FIG. 1B, whose one surface 3*a* (hereinafter referred to as a top face) has straight grooves 3*t* and straight protrusions 3*p* arranged alternatively in the width direction thereon and whose other surface 3*b* (hereinafter referred to as a back face) is substantially flat. Such a nonwoven fabric 3 can be made by a well-known process of blowing air (see Japanese Unexamined Patent Application Publication No. 2009-11179, etc.); fibers which existed at positions corresponding to the grooves 3*t* are blown and shifted to be carried onto portions corresponding to the protrusions 3*p*. In order to increase the liquid-permeability of the top sheet 3, it is possible to a plurality of through holes 3*h* penetrating in the thickness direction can be provided in each of the grooves 3*t*.

== Recovering Bulkiness of Nonwoven Fabric 3 ==

Generally, the nonwoven fabric 3, which is used as material of the top sheet 3 of the pet pad 1, etc., after manufacture, is wound in rolls to be stored in a form of a web roll of nonwoven fabric. And in manufacturing products, the nonwoven fabric 3 is fed out from the web roll of nonwoven fabric and used. At the time of winding the nonwoven fabric 3, the nonwoven fabric 3 is subject to tension in order to prevent meandering of the nonwoven fabric 3 and in order to downside the web roll of the nonwoven fabric. Thus, the nonwoven fabric 3 wound in a roll is compressed in the thickness direction, and the bulkiness of the nonwoven fabric 3 decreases. This leads to decrease in liquid drainage, liquid return, and flexibility of the nonwoven fabric 3. In the invention, the bulkiness of the nonwoven fabric 3 is recovered by blowing hot air to heat the nonwoven fabric 3. A bulkiness recovery apparatus (a bulkiness recovery method) for the nonwoven fabric 3 will be described in detail below.

As an example of the nonwoven fabric 3 according to the invention, the nonwoven fabric 3 whose top face 3*a* has an uneven shape as shown in FIG. 1B is described. The average basis weight of the nonwoven fabric 3 shown in FIG. 1B is, for example, 10 to 200 (g/m$^2$). The average basis weight at the centers of the protrusions 3*p* is, for example, 15 to 250 (g/m), and the average basis weight at the bottoms of the grooves 3*t* is 3 to 150 (g/m$^2$). However, the invention is not limited thereto. For example, nonwoven fabric may have both surfaces which are substantially flat, and also nonwoven fabric may have both surfaces which each have an uneven shape.

A fiber constituting the nonwoven fabric 3 according to the invention is thermoplastic resin fiber (thermal fusing fiber). And, composite fiber having a core-sheath structure of a PET core and a PE sheath, composite fiber having a core-sheath structure of a PP core and a PE sheath, fibers having side-by-side structure, or single fiber made of one thermoplastic resin can be used for example. Also, the nonwoven fabric 3 may have crimped fiber, which is fiber having crimped shape such as zigzag shape, Ω-shape, spiral shape or the like. As the nonwoven fabric 3, nonwoven fabric having a fiber length within a range, for example, between 20 and 100 mm may be used, and also nonwoven fabric having a size, for example, within a range between 1.1 and 8.8 dtex.

First Embodiment

<<Bulkiness Recovery Apparatus for Nonwoven Fabric>>

Figure 2A:
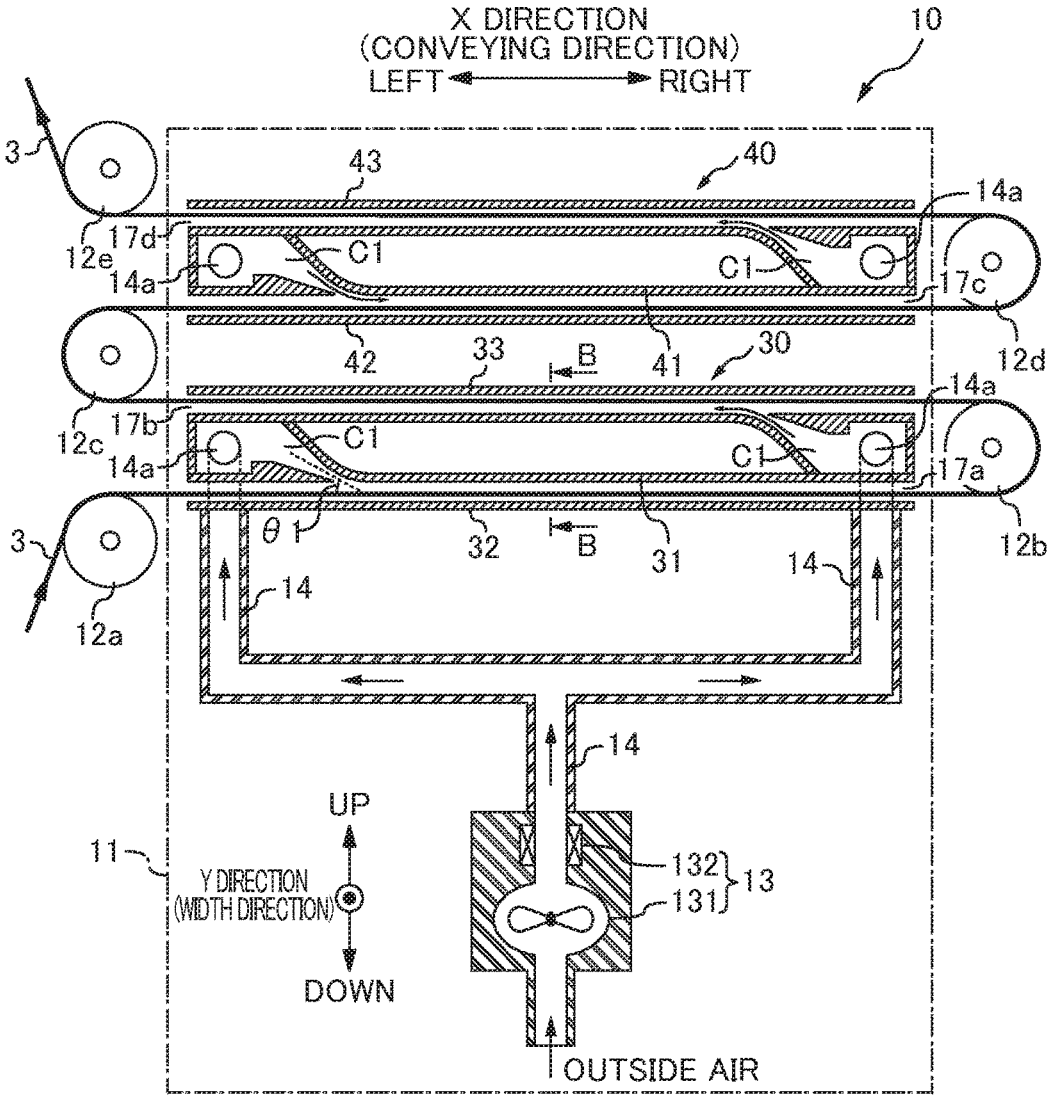
FIG. 2A is a cross sectional view of a bulkiness recovery apparatus for nonwoven fabric according to the first embodiment.
Figure 2B:
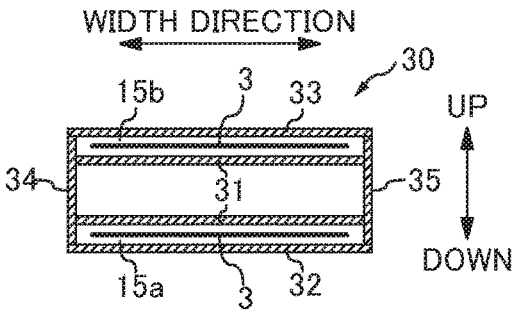
FIG. 2B is a cross sectional view of a first case member taken along line B-B in FIG. 2A.
Figure 3:
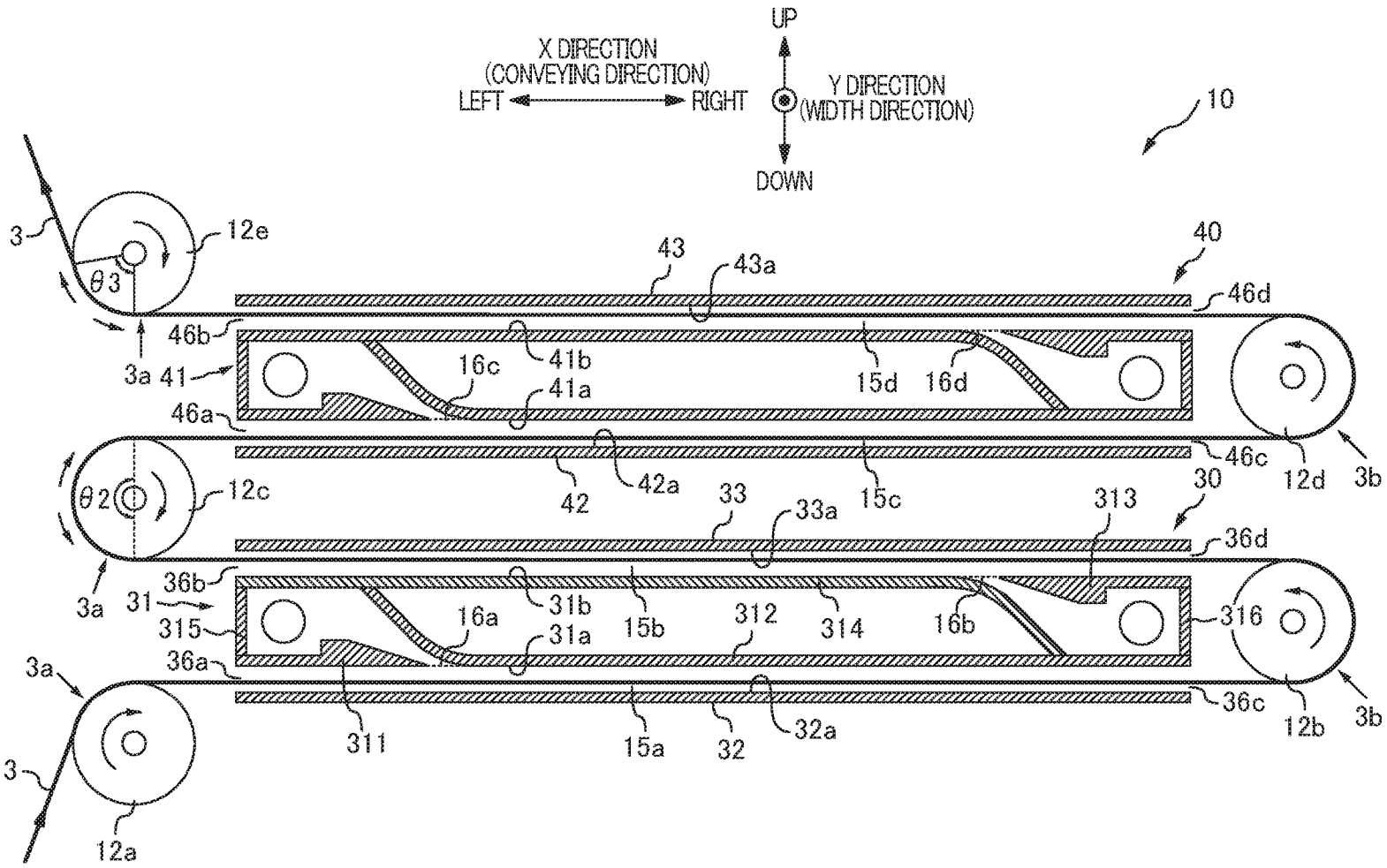
FIG. 3 is a cross sectional view of first and second case members and their vicinity.

FIG. 2A is a cross sectional view of a bulkiness recovery apparatus 10 of nonwoven fabric 3 according to the first embodiment (a cross sectional view in which the width direction of the nonwoven fabric 3 is the normal direction). FIG. 2B is a cross sectional view of a first case member 30 taken along line B-B in FIG. 2A. FIG. 3 is a cross sectional view of the first case member 40, the second case member 30 and their vicinity (a cross sectional view in which the width direction of the nonwoven fabric 3 is the normal direction). Recovering the bulkiness of the following nonwoven fabric 3 will be described below as an example: nonwoven fabric 3 is used as the top sheet 3 of the pet pad 1 (FIG. 1B) and is continuous fabric fed out from a web roll of nonwoven fabric (not shown) wound in roll. The direction in which the grooves 3*t* and the protrusions 3*p* formed on the top face 3*a* of the nonwoven fabric 3 extend is direction in which the nonwoven fabric 3 continues. The X direction shown in the drawings corresponds to the conveying direction of the nonwoven fabric 3 in the first and second case members 30 and 40. The Y direction shown in the drawings corresponds to the width direction of the nonwoven fabric 3. The direction normal to the X direction and the Y direction is in the up-down direction.

The bulkiness recovery apparatus 10 of the nonwoven fabric 3 according to the first embodiment includes: a heating unit 11; and conveying rollers 12*a* to 12*e* conveying the nonwoven fabric 3. The heating unit 11 includes: a hot-air source 13 (see FIG. 2A); a hot-air duct 14; a first case member 30 (corresponding to the case unit); a second case member 40 (corresponding to the case unit); jet inlets 16*a* to 16*d* which blasts hot air into conveyor spaces 15*a* to 15*d* of the nonwoven fabric 3, and which are formed in the first and second case members 30 and 40 (see FIG. 3); and evacuation openings 17*a* to 17*d* which evacuates hot air from the conveyor spaces 15*a* to 15*d* (see FIG. 2A). The nonwoven fabric 3 is heated inside the conveyor spaces 15*a* to 15*d*. For the sake of explanation, in an order from upstream to downstream of the conveying path of the nonwoven fabric 3, the conveying rollers are referred to as a first conveying roller 12*a*, a second conveying roller 12*b*, a third conveying roller 12*c*, a fourth conveying roller 12*d*, and a fifth conveying roller 12*e*.

The hot-air source 13 includes a fan 131 and a heater 132. The fan 131 takes outside air and forces to the hot-air duct 14 air which has been heated by the heater 132. It is preferable that the number of rotations of the fan 131 is changeable so that the volume of hot air is adjustable, and that the temperature of the heater 132 is changeable so that the temperature of hot air is adjustable. In this embodiment, for each of the case members 30 and 40, one hot-air source 13 is provided. However, the invention is not limited thereto. For example, one hot-air source 13 may be provided for each of the conveyor spaces 15*a* to 15*d*, or it is sufficient that a single hot-air source 13 is provided in the heating unit 11. In FIG. 2A, the hot-air source 13 and the hot-air duct 14 for the second case member 40 are omitted. In this embodiment, though hot air (flowing heated air) is blown to the nonwoven fabric 3 to heat the nonwoven fabric 3, such air flow includes in the wider sense flow of gas such as nitrogen gas and inert gases. Accordingly, the nonwoven fabric 3 may be heated by blowing, for example, nitrogen gas to the nonwoven fabric 3.

The first case member 30 includes: a base member 31; a first cover member 32 provided facing the lower surface 31*a* of the base member 31 with spacing therebetween; a second cover member 33 provided facing the upper surface 31*b* of the base member 31 with spacing therebetween; and a pair of side plates 34 and 35 facing each other in the width direction of the nonwoven fabric 3 (see FIG. 2B). Inside the first case member 30, two conveyor spaces 15*a* and 15*b* of the nonwoven fabric 3 are arranged in the up-down direction. More specifically, the first conveyor space 15*a* is partitioned by the lower surface 31*a* of the base member 31, the upper surface 32*a* of the first cover member 32 and a pair of side plates 34 and 35; and the second conveyor space 15*b* is partitioned by the upper surface 31*b* of the base member 31, the lower surface 33*a* of the second cover member 33 and a pair of side plates 34 and 35.

In the first conveyor space 15*a*, the nonwoven fabric 3 is conveyed from left to right in the X direction (the conveying direction), and in the second conveyor space 15*b*, the nonwoven fabric 3 is conveyed from right to left in the X direction. Accordingly, on the left side surface of the first case member 30 in the X direction, there are formed an inlet 36*a* of the nonwoven fabric 3 to the first conveyor space 15*a*

(see FIG. 3) and an outlet 36*b* from the second conveyor space 15*b*. On the right side surface of the first case member 30 in the X direction, there are formed an outlet 36*c* of the nonwoven fabric 3 from the first conveyor space 15*a*, and an inlet 36*d* to the second conveyor space 15*b*.

As shown in FIG. 3, the base member 31 included in the first case member 30 includes: a first lower-surface member 311 and a second lower-surface member 312 constituting the lower surface 31*a* of the base member 31; a first upper-surface member 313 and a second upper-surface member 314 constituting the upper surface 31*b* of the base member 31; a left side member 315 which connects the first lower-surface member 311 and the second upper-surface member 314; and a right side member 316 which connects the second lower-surface member 312 and the first upper-surface member 313. A slit-like first jet inlet 16*a* is formed in a left portion of the lower surface 31*a* of the base member 31 in the X direction, in other words, in a portion on the side closer to the inlet 36*a* of the first conveyor space 15*a*. Also, a slit-like second jet inlet 16*b* is formed in a right portion of the upper surface 31*b* of the base member 31 in the X direction, in other words, in a portion on the side closer to the inlet 36*d* of the second conveyor space 15*b*. It is preferable that the length of each of the jet inlets 16*a* and 16*b* in the Y direction is larger than the length of the nonwoven fabric 3 in the width direction so that the entire part of the nonwoven fabric 3 in the width direction is heated.

Inside the base member 31, hot-air chambers C1 are formed on both sides in the X direction (see FIG. 2A). Hot-air chambers C1 respectively communicate with end openings 14*a* of the hot-air duct 14, and also communicate with the corresponding conveyor spaces 15*a* or 15*b* through the jet inlets 16*a* or 16*b*. Accordingly, hot air from the hot-air source 13 is supplied to the hot-air chambers C1 through the hot-air duct 14, and thereafter the hot air is blasted from the jet inlets 16*a* and 16*b* toward the conveyor spaces 15*a* and 15*b*. A part of each hot-air chamber C1 is a nozzle in which a flow path of hot air gradually narrows toward the jet inlets 16*a* and 16*b*.

Specifically speaking, as shown in FIG. 3, a left end part of the second lower-surface member 312 in the X direction is bent toward inside the base member 31, and a space between the first lower-surface member 311 and the bend-starting part of the member 312 serves as the first jet inlet 16*a*. The hot-air chamber C1 which communicates with the first conveyor space 15*a* is partitioned by the bent part of the second lower-surface member 312, the first lower-surface member 311, the second upper-surface member 314, the left side member 315 and a pair of side plates 34 and 35 (see FIG. 2B). The hot-air chamber C1 which communicates with the second conveyor space 15*b* has a shape obtained by reversing in the X direction and in the up-down direction the hot-air chamber C1 which communicates with the first conveyor space 15*a*.

In the first embodiment, in the conveyor spaces 15*a* and 15*b*, hot air flows along the conveying direction of the nonwoven fabric 3 from upstream (one side) to downstream (other side) while hot air being in contact with one of two surfaces of the nonwoven fabric 3 (the top face 3*a* in this example). For this purpose, a nozzle of the hot-air chamber C1 has a tapered cross section (the normal direction is the Y direction) in which the diameter is substantially reduced toward downstream in the conveying direction, and the tip end of the tapered shape serves as each of the jet inlets 16*a* and 16*b*. And, hot air is blasted toward downstream in the conveying direction at an acute angle θ1 to the surface of the nonwoven fabric 3. It is preferable that the angle θ1 between the surface of the nonwoven fabric 3 (the conveying direction) and a direction in which hot air is blasted at the positions of the jet inlets 16*a* and 16*b* is within a range from 0° to 30°. It is more preferable that the angle θ1 is within a range from 0° to 10°. This allows hot air to flow more reliably along the surface of the nonwoven fabric 3.

The second case member 40 has the same configuration as the first case member 30, and includes a base member 41, a first cover member 42 and a second cover member 43. A space between a lower surface 41*a* of the base member 41 and an upper surface 42*a* of the first cover member 42 serves as the third conveyor space 15*c* of the nonwoven fabric 3. And, A space between an upper surface 41*b* of the base member 41 and a lower surface 43*a* of the second cover member 43 serves as the fourth conveyor space 15*d* of the nonwoven fabric 3. In the third conveyor space 15*c*, the nonwoven fabric 3 is conveyed from left to right in the X direction, and in the fourth conveyor space 15*d*, the nonwoven fabric 3 is conveyed from right to left in the X direction. Accordingly, an inlet 46*a* and an outlet 46*b* are formed in the left side surface of the second case member 40 in the X direction; the nonwoven fabric 3 is conveyed from the inlet 46*a* into the third conveyor space 15*c* and is conveyed from the fourth conveyor space 15*d* to the outlet 46*b*. An outlet 46*c* and an inlet 46*d* are formed in the right side surface of the second case member 40 in the X direction; the nonwoven fabric 3 is conveyed from the third conveyor space 15*c* to the outlet 46*c* and from the inlet 46*d* to the fourth conveyor space 15*d*. In addition, a slit-like third jet inlet 16*c* is formed in a left portion (a portion on the side of the inlet 46*a*) of the lower surface 41*a* of the base member 41 in the X direction. A slit-like fourth jet inlet 16*d* is formed in a right portion (a portion on the side of the inlet 46*d*) of the upper surface 41*b* of the base member 41 in the X direction. Hot-air chambers C1 are formed inside the base member 41, and each hot-air chamber C1 communicates with the corresponding conveyor space 15*c* or 15*d* through the jet inlets 16*c* or 16*d* and also communicates with the end opening 14*a* of the hot-air duct 14.

The second case member 40 is placed next to the first case member 30 in the up-down direction, and is positioned above the first case member 30. Thus, four conveyor spaces 15*a* to 15*d* formed in the first and second case members 30 and 40 are aligned in the up-down direction, and in other words, the spaces are aligned in the direction perpendicular to the conveying direction of the nonwoven fabric 3 (normal to a surface of the nonwoven fabric 3) inside the conveyor spaces 15*a* to 15*d*. Aligning the first and second case members 30 and 40 in the up-down direction as mentioned above makes it possible to shorten the length of the heating unit 11 in the X direction while ensuring a heat time (the length of the conveying path) sufficient to recover the bulkiness of the nonwoven fabric 3. Thus, this makes it possible to downsize the heating unit 11. The first and second case members 30 and 40 may be aligned in a direction tilted to the up-down direction.

<<Bulkiness Recovery Method for Nonwoven Fabric>>

With a bulkiness recovery apparatus 10 having the foregoing configuration, the bulkiness of the nonwoven fabric 3 is recovered. in this embodiment, hot air flows along the conveying direction of the nonwoven fabric 3 while hot air being in contact with the top face 3*a* of the nonwoven fabric 3 (an uneven surface). Accordingly, as shown in FIG. 3, the nonwoven fabric 3 is first wound around the first conveying roller 12*a* so that its top face 3*a* is on the side of the outer circumferential face. Then, the nonwoven fabric 3 is supplied into the first conveyor space 15*a*, and is conveyed inside the first conveyor space 15*a* from left to right in the conveying direction (the X direction). Inside the first conveyor space 15*a*, since the top face 3*a* of the nonwoven fabric 3 faces the first jet inlet 16*a*, hot air which has been blasted from the first jet inlet 16*a* flows toward right (downstream) along the conveying direction of the nonwoven fabric 3 while being in contact with the top face 3*a* of the nonwoven fabric 3. Consequently, the nonwoven fabric 3 is heated and its bulkiness recovers. In addition, because of hot air which is blasted from the first jet inlet 16*a*, the temperature in the first conveyor space 15*a* is higher than temperature outside the first case member 30. Also, for this reason, the nonwoven fabric 3 is heated and its bulkiness recovers.

Thereafter, the nonwoven fabric 3 which has been discharged from the first conveyor space 15*a* is wound around the second conveying roller 12*b* so that its back face 3*b* is on the side of the outer circumferential face, and its direction of motion is reversed. Then, the nonwoven fabric 3 is supplied into the second conveyor space 15*b*, and is conveyed inside the second conveyor space 15*b* from right to left in the conveying direction. At this stage, hot air which has been blasted from the second jet inlet 16*b* flows toward left (downstream) along the conveying direction of the nonwoven fabric 3 while being in contact with the top face 3*a* of the nonwoven fabric 3.

Similarly, the nonwoven fabric 3 which has been discharged from the second conveyor space 15*b* is wound around the third conveying roller 12*c* so that its top face 3*a* is on the side of the outer circumferential face, and its direction of motion is reversed. Then, the nonwoven fabric 3 is supplied into the third conveyor space 15*c*, and is conveyed from left to right in the conveying direction. At this stage, hot air which has been blasted from the third jet inlet 16*c* flows toward right (downstream) along the conveying direction of the nonwoven fabric 3 while being in contact with the top face 3*a* of the nonwoven fabric 3. The nonwoven fabric 3 which has been discharged from the third conveyor space 15*c* is wound around the fourth conveying roller 12*d* so that its back face 3*b* is on the side of the outer circumferential face, and its direction of motion is reversed. Then, the nonwoven fabric 3 is supplied into the fourth conveyor space 15*d*, and is conveyed from right to left in the conveying direction. At this stage, hot air which has been blasted from the fourth jet inlet 16*d* flows toward left (downstream) along the conveying direction of the nonwoven fabric 3 while being in contact with the top face 3*a* of the nonwoven fabric 3.

Accordingly, inside the second to the fourth conveyor spaces 15*b* to 15*d*, the nonwoven fabric 3 is heated by hot air which has been blasted to the conveyor spaces 15*b* to 15*d*. In addition, since the conveyor spaces 15*b* to 15*d* are hot, the nonwoven fabric 3 is further heated, and the bulkiness of the nonwoven fabric 3 is recovered. When the nonwoven fabric 3 has been discharged from the fourth conveyor space 15*d*, its bulkiness recovers. The nonwoven fabric 3 in such a state is wound around the fifth conveying roller 12*e* with its top face 3*a* being on the side of the outer circumferential face, and its direction of motion is changed. Finally, the nonwoven fabric 3 is conveyed to the next process.

When the nonwoven fabric 3 is being conveyed inside the conveyor spaces 15*a* to 15*d*, the nonwoven fabric 3 is not supported by any member. But, in order to prevent the nonwoven fabric 3 from being loosened and coming into contact with the case members 30 and 40, tension is exerted on the nonwoven fabric 3. Hot air which has been blasted from the jet inlets 16*a* to 16*d* is flowing while being in contact with the top face 3*a* of the nonwoven fabric 3, and is subsequently discharged through the outlets 36*b*, 36*c*, 46*b* and 46*c* from the case members 30 and 40 (the conveyor spaces 15*a* to 15*d*). Strictly speaking, parts of each of the outlets 36*b*, 36*c*, 46*b* and 46*c* for the nonwoven fabric 3, which are on the side of the jet inlets 16*a* to 16*d* in the up-down direction with respect to the nonwoven fabric 3, serve as the evacuation openings 17*a* to 17*d* for hot air.

It is preferable that the temperature of hot air at the jet inlets 16*a* to 16*d* is set to be lower than the melting point of thermoplastic resin fiber contained in the nonwoven fabric 3 and to be equal to or higher than a temperature of 50° C. below the melting point of the thermoplastic resin fiber. This makes it possible to reliably recover the bulkiness of the nonwoven fabric 3 as well as to suppress melting of thermoplastic resin fiber.

It is preferable that the speed of hot air is larger than the speed at which the nonwoven fabric 3 is conveyed inside the conveyor spaces 15*a* to 15*d*. In this case, since hot air flowing on the top face 3*a* of the nonwoven fabric 3 becomes turbulent, heat transfer efficiency improves and the nonwoven fabric 3 can be efficiently heated. In addition, the turbulent hot air loosens fibers of the nonwoven fabric 3 to facilitate bulkiness recovery. For example, it is preferable that the speed of hot air is set to be within a range from 1000 to 3000 (m/min.), and that the speed at which the nonwoven fabric 3 is conveyed is set to be within a range from 100 to 500 (m/min.). The speed of hot air (m/min.) is a value obtained by dividing the volume ($m^3$/min.) supplied to the conveyor spaces 15*a* to 15*d* by the cross section ($m^2$) of the conveyor spaces 15*a* to 15*d* taken along the up-down direction. It is preferable that the relationship between the speed of air flow and the conveying speed is established through the entire length of the conveyor spaces 15*a* to 15*d*. But, even if the foregoing relationship is established in parts of the conveyor spaces 15*a* to 15*d*, the effect of turbulent hot air can be achieved.

As mentioned above, in the first embodiment, inside the conveyor spaces 15*a* to 15*d* for the nonwoven fabric 3 formed in the first and second case members 30 and 40, hot air is blasted from one side to the other side (in this example, from upstream to downstream) in the direction in which the nonwoven fabric 3 is conveyed inside the conveyor spaces 15*a* to 15*d*. And, hot air flows along the conveying direction of the nonwoven fabric 3 while being in contact with one surface of the nonwoven fabric 3 (the top face 3*a* in this example). Consequently, the nonwoven fabric 3 is heated, and the bulkiness of the nonwoven fabric 3, which has decreased by means such as winding the fabric in rolls, is recovered. This invention is not limited to blowing hot air to the top face 3*a* of the nonwoven fabric 3 (an uneven surface) shown in FIG. 1B. Hot air may be blown to the back face 3*b* (a flat surface).

Supposing that the nonwoven fabric 3 is heated by blowing hot air to a surface of the nonwoven fabric 3 in the direction normal to the surface. In this case, bulkiness recovery effect of the nonwoven fabric 3, which is achieved by heating the fabric 3, may decrease because hot air is blown to the nonwoven fabric 3 in the opposite direction to the direction in which the bulkiness of the nonwoven fabric 3 recovers (the direction in which the bulkiness is compressed). Further, the nonwoven fabric 3 may be insufficiently heated. This is because air surrounding the nonwoven fabric 3 is flowing as the nonwoven fabric 3 is conveyed and the surrounding air interrupts flowing of hot air which should be blown to the surface of the nonwoven fabric 3 in the direction normal to the surface. On the other hand, in the first embodiment, hot air does not flow in the direction in which the bulkiness of the nonwoven fabric 3 decreases, but hot air flows along the conveying direction of the nonwoven fabric 3 while hot air being in contact with a surface of the nonwoven fabric 3. This makes it possible to prevent decrease of bulkiness recovery effect of the nonwoven fabric 3.

Also, it is possible to prevent interruption in heating the nonwoven fabric 3 caused by air which is flowing together with the nonwoven fabric 3 being conveyed.

Since the nonwoven fabric 3 is softened by heating, the nonwoven fabric 3 after being heated is more likely to stretch in the conveying direction due to tension exerted on the nonwoven fabric 3 for conveyance purpose. When the nonwoven fabric 3 stretches in conveying direction, the width of the nonwoven fabric 3 will vary or its bulkiness recovery effect will decrease. In the first embodiment, the jet inlets 16*a* to 16*d* are provided in upstream (in the conveying direction) parts of the conveyor spaces 15*a* to 15*d* formed in the first and second case members 30 and 40, and hot air flows from upstream to downstream in the conveying direction of the nonwoven fabric 3. Thus, if a direction in which hot air is flowing is the same as the conveying direction of the nonwoven fabric 3, it is possible to suppress, to the extent possible, tension exerted on the nonwoven fabric 3 for conveyance purpose compared to a case in which the direction in which hot air is flowing is opposite the conveying direction of the nonwoven fabric 3. This makes it possible to prevent the variation in the width of the nonwoven fabric 3 and decrease of bulkiness recovery effect. In addition, it is possible to efficiently convey the nonwoven fabric 3. However, this invention is not limited thereto. The following configuration is also acceptable: the jet inlets are provided in downstream parts of the conveyor spaces 15*a* to 15*d* in the conveying direction of the nonwoven fabric 3, and the jet inlets blast hot air inside the conveyor spaces 15*a* to 15*d* from downstream (one side) toward upstream (the other side) in the conveying direction of the nonwoven fabric 3.

In the top face 3*a* of the nonwoven fabric 3 to which hot air is blown, fibers constituting the nonwoven fabric 3 are more likely to be thermal-fused. Thermal-fusing of fibers makes interfiber space narrower; this may decrease bulkiness recovery effect, which is achieved by heating the nonwoven fabric 3. A surface of the nonwoven fabric 3 in which its fibers are thermal-fused become stiff, and touch and processability deteriorate. However, in the first embodiment, the nonwoven fabric 3 which has been discharged from the second conveyor space 15*b* is wound around the third conveying roller 12*c* so that its top face 3*a*, to which hot air is blown, is on the side of the outer circumferential face. Consequently, the nonwoven fabric 3 is deformed in a curved manner. Similarly, the nonwoven fabric 3 which has been discharged from the fourth conveyor space 15*d* is wound around the fifth conveying roller 12*e* so that its top face 3*a*, to which hot air is blown, is on the side of the outer circumferential face. Consequently, the nonwoven fabric 3 is deformed in a curved manner. That is, after the nonwoven fabric 3 is discharged from the first and second case members 30 and 40, the third and fifth conveying rollers 12*c* and 12*e* (corresponding to the deformation mechanism) deforms the nonwoven fabric 3 so that the top face 3*a* of the nonwoven fabric 3, to which hot air is blown, is convex.

Consequently, tensile force along the circumferential direction of the third and fifth conveying rollers 12*c* and 12*e* (tensile force toward upstream in the conveying path and tensile force toward downstream in the conveying path) is exerted on the top face 3*a* of the nonwoven fabric 3 which is wound around the third and fifth conveying rollers 12*c* and 12*e*. And, thermal-fused fibers are loosened on the side of the top face 3*a* of the nonwoven fabric 3. Accordingly, interfiber space in the nonwoven fabric 3 is widen, and this makes it possible to prevent decrease bulkiness recovery effect, which is achieved by heating the nonwoven fabric 3. In addition, the top face 3*a* of the nonwoven fabric 3 is softened by loosening fibers on the side of the top face 3*a* of the nonwoven fabric 3. Consequently, touch and processability (e.g. ease of bending) improve. In particular, in the first embodiment, after the nonwoven fabric 3 is finally discharged from the fourth conveyor space 15*d*, the fifth conveying roller 12*e* deforms the nonwoven fabric 3 so that the top face 3*a* of the nonwoven fabric 3 is convex. Accordingly, in the nonwoven fabric 3, fibers in the top face 3*a* of the nonwoven fabric 3 which have been thermal-fused in the final, fourth conveyor space 15*d* are loosened, and the nonwoven fabric 3 in the foregoing state is conveyed to the next process. Accordingly, quality of products in which the nonwoven fabric 3 is used can further increase.

In the first embodiment, the following mechanisms correspond to the heating mechanism according to the invention: the mechanism which heats the nonwoven fabric 3 inside the second conveyor space 15*b* (the mechanism including the first case member 30, the second jet inlet 16*b*, and the second evacuation opening 17*b*); and the mechanism which heats the nonwoven fabric 3 inside the fourth conveyor space 15*d* (the mechanism including the second case member 40, the fourth jet inlet 16*d*, and the fourth evacuation opening 17*d*).

The third and fifth conveying rollers 12*c* and 12*e*, which deforms the nonwoven fabric 3, are provided outside the first and second case members 30 and 40. The temperature outside the first and second case members 30 and 40 is lower than the temperature inside the first and second case members 30 and 40 (inside the conveyor spaces 15*a* to 15*d*), in which hot air is blasted. Accordingly, the third and fifth conveying rollers 12*c* and 12*e* deform the nonwoven fabric 3 which is being spontaneously cooled outside the first and second case members 30 and 40. Since fibers which has been heated and softened are easy to stretch, fibers that are being spontaneously cooled are more likely to separate than heated fibers. Accordingly, deforming the nonwoven fabric 3 which is being spontaneously cooled allows fibers of the nonwoven fabric 3 to be more reliably loosened.

If the nonwoven fabric 3 which is being spontaneously cooled is deformed, the nonwoven fabric 3 is less likely to have deformation tendency (a tendency to be curved along the outer circumferential faces of the third and fifth conveying rollers 12*c* and 12*e*), compared to a case, for example, in which the nonwoven fabric 3 is deformed in a space in which hot air is blasted. This has the same effect on a case in which the nonwoven fabric 3 is wound around the second and fourth conveying rollers 12*b* and 12*d* outside the first and second case members 30 and 40. This invention is not limited to deforming the nonwoven fabric 3 which is being spontaneously cooled. The nonwoven fabric 3 may be deformed while actively cooling the nonwoven fabric 3. For example, air for cooling (air the temperature of which is lower than the heated nonwoven fabric 3) may be blown to the nonwoven fabric 3 wound around the third and fifth conveying rollers 12*c* and 12*e*.

In the first embodiment, the third and fifth conveying rollers 12*c* and 12*e* wind the nonwoven fabric 3 around their outer circumferential faces to change direction of motion of the nonwoven fabric 3, and convey the nonwoven fabric 3.

And, the third and fifth conveying rollers 12*c* and 12*e* is used to loosen fibers on the side the top face 3*a* of the nonwoven fabric 3. This makes it possible to prevent increase in the number of components, compared to a case in which a mechanism which deforms the nonwoven fabric 3 is provided in addition to the third and fifth conveying rollers 12*c* and 12*e*. In addition, time for recovering bulkiness can be reduced, compared to a case of having a process for deforming the nonwoven fabric 3 in addition to a process for conveying the nonwoven fabric 3. However, the invention is not limited thereto. For example, a semi-cylindrical deformation mechanism, which is not a conveying roller, may be provided on the downstream side of in the conveyor spaces 15*a* to 15*d*. In this embodiment, the nonwoven fabric 3 is deformed so that the nonwoven fabric 3 is convex along its continuing direction. However, the invention is not limited thereto. The nonwoven fabric 3 may be deformed so that the nonwoven fabric 3 is convex along the width direction.

After the nonwoven fabric 3 passed the third conveying roller 12*c*, the nonwoven fabric 3 is in a state in which fibers on the side of the top face 3*a* are loosened to widen interfiber space, and is supplied to the third conveyor space 15*c*. Accordingly, inside the third conveyor space 15*c*, hot air is flowing along the conveying direction of the nonwoven fabric 3 while being in contact with the top face 3*a* of the nonwoven fabric 3 whose fibers are loosened. This can increase the efficiency of heating the nonwoven fabric 3. As mentioned above, after deforming the nonwoven fabric 3 so that its surface to which hot air is blown is convex, the nonwoven fabric 3 is heated again by blowing hot air to the fabric 3. This increases the efficiency of heating the nonwoven fabric 3, and allows the bulkiness of the nonwoven fabric 3 to further recover. However, the invention is not limited thereto. A configuration may be employed in which the nonwoven fabric 3 is not reheated after its deformation. For example, the following configuration may be employed: the heating unit 11 does not includes the second case member 40, the direction of motion of the nonwoven fabric 3 is changed by the third conveying roller 12*c* after being discharged from the second conveyor space 15*b*, and is thereafter conveyed to the next process. In the first embodiment, the following mechanisms correspond to the other heating mechanism according to the invention: the mechanism which heats the nonwoven fabric 3 inside the third conveyor space 15*c* (the mechanism including the second case member 40, the third jet inlet 16*c*, and the third evacuation opening 17*c*).

In the bulkiness recovery apparatus 10 according to the first embodiment, in order to downsize the heating unit 11 in the X direction, the first and second case members 30 and 40 and the conveyor spaces 15*a* to 15*d* are aligned in the up-down direction, that is, in a direction orthogonal to the conveying direction of the nonwoven fabric 3 inside the conveyor spaces 15*a* to 15*d*. Accordingly, for example, the conveying direction of the nonwoven fabric 3 in the second conveyor space 15*b* is opposite the conveying direction in the third conveyor space 15*c*, which is immediately downstream from the second conveyor space 15*b*. In order to supply the third conveyor space 15*c* with the nonwoven fabric 3 which has passed the second conveyor space 15*b*, the third conveying roller 15*c* reverses the nonwoven fabric 3 while conveying the nonwoven fabric 3 wound around its outer circumferential face. The angle area that the nonwoven fabric 3 is wound around the third conveying roller 12*c*, which reverses the nonwoven fabric 3, is greater than the angle area that the nonwoven fabric 3 is wound around the fifth conveying roller 12*e*, which changes the conveying path of the nonwoven fabric 3 to upward from the horizontal direction (the X direction) ($\theta 2 > \theta 3$). As a wound angle area of the nonwoven fabric 3 is greater, the degree of deformation (degree of curving) of the nonwoven fabric 3 increases. This makes it possible to more reliably loosen fibers on the side of the top face 3*a* of the nonwoven fabric 3. That is, since the first and second case members 30 and 40 and the conveyor spaces 15*a* to 15*d* are aligned in the up-down direction, it is possible to downsize the heating unit 11 in the X direction and is also possible to more reliably loosen fibers on the side of the top face 3*a* of the nonwoven fabric 3.

In the first embodiment, the diameters of the first to fifth conveying rollers 12*a* to 12*e* are identical. However, the invention is not limited thereto. For example, the diameters of the third and fifth conveying rollers 12*c* and 12*e*, which are for loosening fibers on the side of the top face 3*a* of the nonwoven fabric 3, may be smaller than the diameters of the other conveying rollers 12*a*, 12*b* and 12*d*. This increases the degree of deformation (degree of curving) of the nonwoven fabric 3 wound around the third and fifth conveying rollers 12*c* and 12*e*. Also, fibers on the side of the top face 3*a* of the nonwoven fabric 3 can be more reliably loosened.

There is possibility that the nonwoven fabric 3 which is heated in the conveyor spaces 15*a* to 15*d* shrinks in its continuing direction. Accordingly, concerning the nonwoven fabric 3 which is wound around the conveying rollers 12*b* to 12*e* located downstream from the conveyor spaces 15*a* to 15*d*, its conveying speed may be decrease to the extent that the nonwoven fabric 3 is not loosened inside the conveyor spaces 15*a* to 15*d*, compared to the speed at which the nonwoven fabric 3 is conveyed around the inlets of the conveyor spaces 15*a* to 15*d*. Specifically speaking, the circumferential speed values of the first conveying roller 12*a* and conveying rollers located upstream therefrom may be greater than the circumferential speed values of the fifth conveying roller 15*e* and conveying rollers located downstream therefrom. Accordingly, the nonwoven fabric 3 which has been softened to be easy to stretch can be prevented to be excessively pulled. Also, it is possible to prevent the variation in the width of the nonwoven fabric 3 and decrease of bulkiness recovery effect.

The nonwoven fabric 3 may be cooled before conveying the nonwoven fabric 3 to the next process. For example, the following configuration may be employed: an apparatus having an almost same configuration as the bulkiness recovery apparatus 10 shown in FIG. 2A except for the heater 132 is provided downstream with respect to the fifth conveying roller 12*e*, and cold air whose temperature is lower than the temperature of the nonwoven fabric 3, instead of hot air, is blown to the nonwoven fabric 3 which is being conveyed inside the first and second case members 30 and 40 (the first to fourth conveyor spaces 15*a* to 15*d*). This makes it possible to prevent the following phenomena that will be caused by high temperature of the nonwoven fabric 3: the variation in the width of the nonwoven fabric 3 due to softening; and decrease of bulkiness recovery effect.

Second Embodiment

Figure 4:
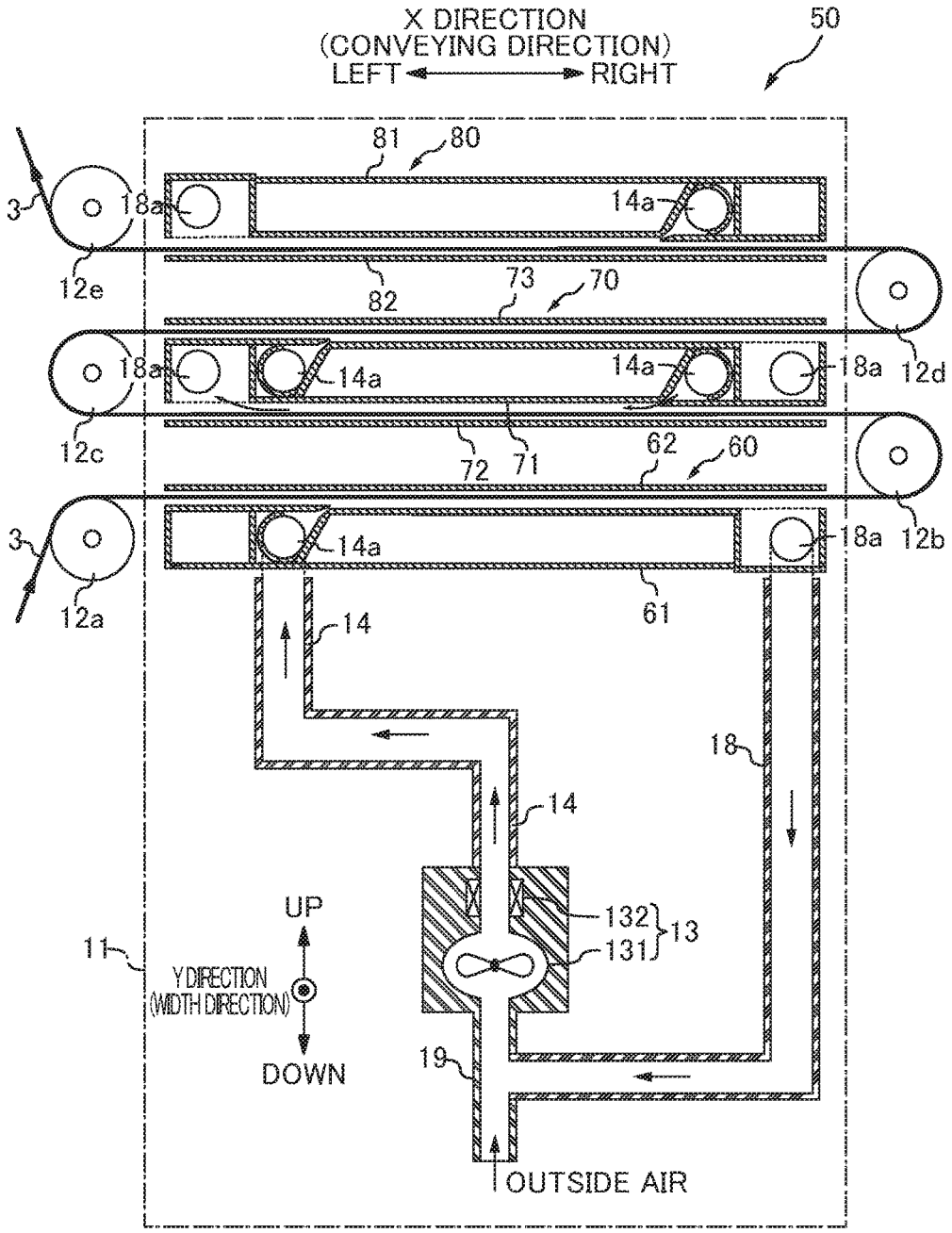
FIG. 4 is a cross sectional view of a bulkiness recovery apparatus for nonwoven fabric according to the second embodiment.
Figure 5:
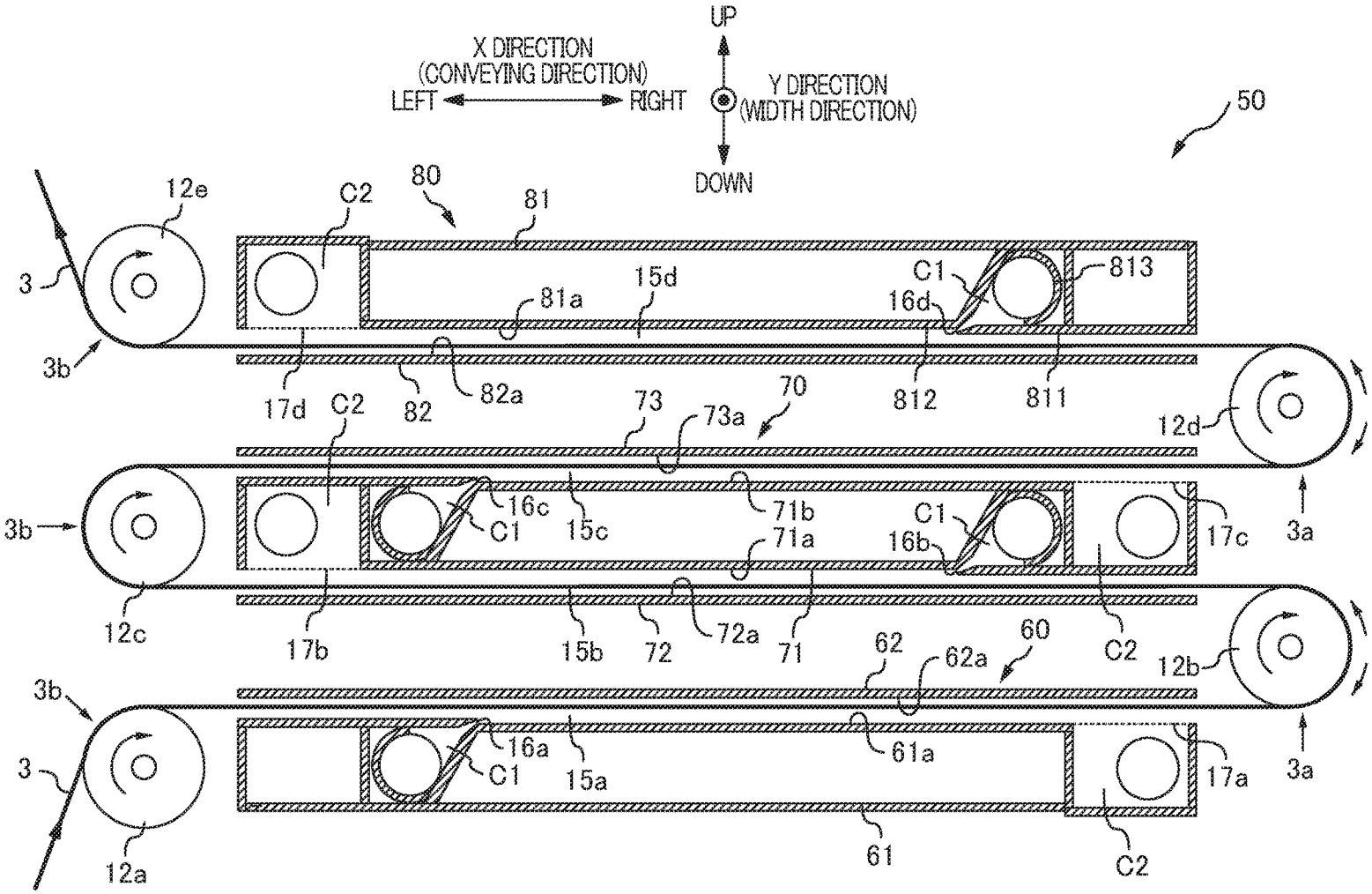
FIG. 5 is a cross sectional view of first to third case members and their vicinity.

FIG. 4 is a cross sectional view of a bulkiness recovery apparatus 50 of the nonwoven fabric 3 according to the second embodiment (a cross sectional view in which the width direction of the nonwoven fabric 3 is the normal direction). FIG. 5 is a cross sectional view of the first to third case members 60 to 80 and their vicinity (a cross sectional view in which the width direction of the nonwoven fabric 3 is the normal direction). The bulkiness recovery apparatus 50 of the nonwoven fabric 3 according to the second embodiment includes the heating unit 11 and the first to fifth conveying rollers 12*a* to 12*e*. The heating unit 11 includes: the hot-air source 13; the hot-air duct 14; a circulating duct 18; the first case member 60 (corresponding to a case unit); the second case member 70 (corresponding to a case unit); the third case member 80 (corresponding to a case unit); the jet inlets 16*a* to 16*d* which blasts hot air to the conveyor spaces 15*a* to 15*d* formed in the first to third case members 60 to 80; and the evacuation openings 17*a* to 17*d* which evacuates hot air from the conveyor spaces 15*a* to 15*d*.

In the second embodiment, though three case members (the first to third case members 60 to 80) are arranged in the up-down direction, the nonwoven fabric 3 is heated in the same manner as in the first embodiment while passing the four conveyor spaces 15*a* to 15*d*, which are formed in the first to third case members 60 to 80. Specifically speaking, the nonwoven fabric 3 passes the following first to fourth conveyor spaces 15*a* to 15*d*: the first conveyor space 15*a* is located between an upper surface 61*a* of a base member 61 and a lower surface 62*a* of a first cover member 62, the members 61 and 62 being included in the first case member 60; the second conveyor space 15*b* is located between a lower surface 71*a* of a base member 71 and an upper surface 72*a* of a first cover member 72, the members 71 and 72 being included in the second case member 70; the third conveyor space 15*c* is located between an upper surface 71*b* of the base member 71 and a lower surface 73*a* of a second cover member 73, the second cover member 73 also being included in the second case member 70; and the fourth conveyor space 15*d* is located between a lower surface 81*a* of a base member 81 and an upper surface 82*a* of a first cover member 82, the members 81 and 82 being included in the third case member 80.

On the upstream sides of the conveyor spaces 15*a* to 15*d* in the conveying direction of the nonwoven fabric 3, the jet inlets 16*a* to 16*d* for hot air are formed. Inside the first to third case members 60 to 80, hot-air chambers C1 are formed. Each of the chambers C1 communicates with the corresponding conveyor spaces 15*a* to 15*d* through either one of the jet inlets 16*a* to 16*d*, and also communicates with end openings 14*a* of the hot-air duct 14. In hot-air chambers C1, flow paths of hot air gradually narrows toward the jet inlets 16*a* to 16*d* respectively.

Specifically speaking, for example, the hot-air chamber C1 which communicates with the fourth conveyor space 15*d* is partitioned by a first lower-surface member 811, a second lower-surface member 812 and a curved member 813, as shown in FIG. 5. The first lower-surface member 811 and the second lower-surface member 812 (bent part) constitute a lower surface 81*a* of the base member 81, and the curved member 813 has a shape along the end opening 14*a* of the hot-air duct 14. The bent part of the second lower-surface member 812 has a cross section (the normal direction is the Y direction) which slopes to the jet inlet 16*d* toward upstream in the conveying direction so that hot air flows from upstream to downstream along the conveying direction of the nonwoven fabric 3 while being in contact with a surface of the nonwoven fabric 3. The first lower-surface member 811 located upstream in the conveying direction is arranged closer to the conveyor space 15*d* in the up-down direction with respect to the second lower-surface member 812. This makes it possible to more reliably flow hot air along the conveying direction of the nonwoven fabric 3. Providing the curved member 813 along the end opening 14*a* of each hot-air duct 14 allows hot air from each hot-air duct 14 to smoothly flow to the jet inlet 16*d*, and can consequently reduce an area where hot air stays in the hot-air chamber C1.

In the second embodiment, hot air which has been blasted from the jet inlets 16*a* to 16*d* is reclaimed. Accordingly, on the downstream sides of the conveyor spaces 15*a* to 15*d* in the conveying direction of the nonwoven fabric 3, the evacuation openings 17*a* to 17*d* of hot air are provided in the base members 61, 71 and 81. Since hot air flows along the conveying direction of the nonwoven fabric 3, the evacuation openings 17*a* to 17*d* are provided on the side of the jet inlets 16*a* to 16*d* with respect to the top face 3*a* of the nonwoven fabric 3. Inside the first to third case members 60 to 80, reclaiming chambers C2 are formed. Each of the reclaiming chambers C2 communicates with the conveyor spaces 15*a* to 15*d* through the evacuation openings 17*a* to 17*d*, and also communicates with end openings 18*a* of the circulating duct 18. The circulating duct 18, which extends from the reclaiming chamber C2 (see FIG. 4), communicates with an intake duct 19 of the hot-air generator 13. In FIG. 4, the hot-air sources 13, the hot-air duct 14 and the circulating duct 18 corresponding to the second and third case members 70 and 80 are omitted. In order to prevent foreign matter (fiber waste of the nonwoven fabric 3, etc.) from circulating together with hot air, a filter which let hot air pass but stop foreign matter may be provided in the evacuation openings 17*a* to 17*d*.

In the foregoing heating unit 11, hot air that has been blasted from the jet inlets 16*a* to 16*d* flows in the conveying direction of the nonwoven fabric 3, and the air is reclaimed from the reclaiming chamber C2 to a circulating duct 18 and is subsequently heated again by the heater 132 of the hot-air generator 13. Then, hot air is forced from the hot-air duct 14 to the conveyor spaces 15*a* to 15*d*. Thus, circulating hot air which heats the nonwoven fabric 3 can increase the efficiency of heating hot air by the heater 132. The volume of hot air which is evacuated outside the first to third case members 60 to 80 decreases. This can decrease effect of hot air on other processes. The temperature outside the first to third case members 60 to 80 can be lowered compared to the foregoing first embodiment. This makes it possible to deform the nonwoven fabric 3 which has been further cooled spontaneously. Accordingly, fibers on the side of the top face 3*a* of the nonwoven fabric 3 are more reliably loosened, and it is possible to prevent the nonwoven fabric 3 from having deformation tendency (tendency to be curved).

In the bulkiness recovery apparatus 50 having the foregoing configuration, the nonwoven fabric 3 is first wound around the first conveying roller 12*a* with its back face 3*b* being on the side of the outer circumferential face. Then, the nonwoven fabric 3 is supplied into the first conveyor space 15*a*, and is conveyed from left to right in the conveying direction. The nonwoven fabric 3 which has been discharged from the first conveyor space 15*a* is wound around the second conveying roller 12*a* with its top face 3*a* being on the side of the outer circumferential face, and the nonwoven fabric 3 is reversed. Then, the nonwoven fabric 3 is supplied into the second conveyor space 15*b*, and is conveyed from right to left in the conveying direction. Similarly, the nonwoven fabric 3 which has been discharged from the second conveyor space 15*b* is wound around the third conveying roller 12*c* with its back face 3*b* being on the side of the outer circumferential face, and he nonwoven fabric 3 is reversed. Then, the nonwoven fabric 3 is supplied into the third conveyor space 15*c*, and is conveyed from left to right in the conveying direction. The nonwoven fabric 3 which has been discharged from the third conveyor space 15*c* is wound around the fourth conveying roller 12*d* with its top face 3*a* being on the side of the outer circumferential face, and he nonwoven fabric 3 is reversed. Then, the nonwoven fabric 3 is supplied into the fourth conveyor space 15*d*, and is conveyed from right to left in the conveying direction. The nonwoven fabric 3 which has been discharged from the fourth conveyor space 15*d* is wound around the fifth conveying roller 12*e* with its back face 3*b* being on the side of the outer circumferential face, and its direction of motion is changed. Finally, the nonwoven fabric 3 is conveyed to the next process.

Inside the conveyor spaces 15*a* to 15*d*, since hot air flows along the conveying direction of the nonwoven fabric 3 while being in contact with the top face 3*a* of the nonwoven fabric 3, the nonwoven fabric 3 is heated. In addition, since it is hot inside the conveyor spaces 15*a* to 15*d*, the nonwoven fabric 3 is further heated and the bulkiness of the nonwoven fabric 3 is recovered. Hot air flows along the conveying direction of the nonwoven fabric 3, but hot air does not flow in the direction in which the bulkiness of the nonwoven fabric 3 decreases. This makes it possible to prevent decrease of bulkiness recovery effect, which is achieved by heating the nonwoven fabric 3.

After the nonwoven fabric 3 is discharged from the first and second case members 30 and 40, the second and fourth conveying rollers 12*b* and 12*d* (corresponding to the deformation mechanism) deforms the nonwoven fabric 3 so that the top face 3*a* of the nonwoven fabric 3 to which hot air is blown is convex. Accordingly, since thermal-fused fibers in the top face 3*a* of the nonwoven fabric 3 are loosened to widen interfiber space in the nonwoven fabric 3. Consequently, it is possible to prevent decrease of bulkiness recovery effect, which is achieved by heating the nonwoven fabric 3. Also, it is possible to soften the top face 3*a* of the nonwoven fabric 3. In the second embodiment, the following mechanisms correspond to the heating mechanism according to the invention: the mechanism which heats the nonwoven fabric 3 inside the first conveyor space 15*a* (the mechanism including the first case member 30, the first jet inlet 16*a*, and the first evacuation opening 17*a*); and the mechanism which heats the nonwoven fabric 3 inside the third conveyor space 15*c* (the mechanism including the second case member 40, the third jet inlet 16*c*, and third evacuation opening 17*c*).

After the nonwoven fabric 3 is deformed by the second and fourth conveying rollers 12*b* and 12*d* so that its top face 3*a* is convex, the nonwoven fabric 3 is reheated in the second conveyor space 15*b* and in the fourth conveyor space 15*d*. In the second embodiment, the nonwoven fabric 3 in which fibers on the side of the top face 3*a* have been loosened by the conveying roller is reheated more times than in the first embodiment. Reheating the nonwoven fabric 3 in which fibers on the side of the top face 3*a* are loosened increases the efficiency of heating the nonwoven fabric 3. Accordingly, in the second embodiment, the efficiency of heating the nonwoven fabric 3 further increases, and it is possible to more reliably recover the bulkiness of the nonwoven fabric 3. However, since the number of the case members in the first embodiment is smaller than that in the second embodiment, it is possible to downsize the heating unit 11 in the up-down direction. In the second embodiment, the following mechanisms correspond to the other heating mechanism according to the invention: the mechanism which heats the nonwoven fabric 3 inside the second conveyor space 15*b* (the mechanism including the first case member 30, the second jet inlet 16*b*, and the second evacuation opening 17*b*); and the mechanism which heats the nonwoven fabric 3 inside the fourth conveyor space 15*d* (the mechanism including the second case member 40, the fourth jet inlet 16*d*, and the fourth evacuation opening 17*d*).

In the second embodiment, the fifth conveying roller 12*e* deforms the nonwoven fabric 3 which has been discharged from the final fourth conveyor space 15*d* so that the back face 3*b* of the nonwoven fabric 3 is convex. A conveying roller to deform the nonwoven fabric 3 so that the top face 3*a* of the nonwoven fabric 3 is convex may be provided downstream with respect to the fifth conveying roller 12*e*. Thus, in the nonwoven fabric 3, fibers in the top face 3*a* of the nonwoven fabric 3 which have been thermal-fused in the final, fourth conveyor space 15*d* are loosened, and the nonwoven fabric 3 in the foregoing state is conveyed to the next process. Accordingly, quality of products in which the nonwoven fabric 3 is used can further increase.

Other Embodiments

While the embodiments of the invention are described above, the embodiments are for the purpose of elucidating the understanding of the invention and are not to be interpreted as limiting the invention. The invention can of course be altered and improved without departing from the gist thereof, and equivalents are intended to be embraced therein.

In the foregoing embodiments, the heating unit 11 installed in horizontal orientation is described as an example, in which the nonwoven fabric 3 is conveyed along the X direction (horizontal direction) inside the case members 30, 40, 60 to 80. However, the invention is not limited thereto. For example, a heating unit installed in vertical orientation may be employed in which the nonwoven fabric is conveyed along the up-down direction inside case members. In the foregoing embodiments, a plurality of the case members 30, 40, 60 to 80 are arranged in the up-down direction, and hot air is blown multiple times to the nonwoven fabric 3 while the nonwoven fabric 3 passing a plurality of the conveyor spaces 15*a* to 15*d* respectively formed in the case members 30, 40, 60 to 80. However, the invention is not limited thereto. For example, a plurality of case members may be arranged in the horizontal direction (a direction along the direction in which nonwoven fabric is conveyed in the case members). Further, nonwoven fabric may be heated inside a single conveyor space formed in a single case member which is elongated in the continuing direction of the nonwoven fabric 3. Also, hot air may be blown only once to nonwoven fabric. In these cases, it is not necessary to reverse nonwoven fabric between case members, and a mechanism for deforming nonwoven fabric so that the surface to which hot air is blown is convex (conveying roller) is provided between the case members or downstream with respect to the case members.

In the foregoing embodiments, each of the case members 30, 40, 60 to 80 has one or two of the conveyor spaces 15*a* to 15*d* of the nonwoven fabric 3 formed therein. However, the invention is not limited thereto. Three or more conveyor spaces of nonwoven fabric may be formed in one case member. In the foregoing embodiments, the heating unit 11 has two or three of the case members 30, 40, 60 to 80. However, the invention is not limited thereto. The heating unit may have a single case member or may have four or more case members.

In the foregoing embodiment, the bulkiness of the nonwoven fabric 3 which is used as the top sheet 3 of the pet pad 1 (FIG. 1B) is recovered as an example. However, the invention is not limited thereto. For example, the invention is effective in recovering the bulkiness of nonwoven fabric which is used for an absorbent article such as sanitary napkin or disposable diaper or is used as a cleaning sheet, etc. attached to a cleaning mop. Further, in the foregoing embodiments, the bulkiness of continuous nonwoven fabric 3 wound in a roll is recovered as an example. However, the invention is not limited thereto. For example, the invention is also effective in recovering the bulkiness of nonwoven fabric which is cut to a certain length. This is because there is a possibility that the bulkiness of nonwoven fabric which has been cut to a certain length decreases if the nonwoven fabric is stored in a stacked manner.

REFERENCE SIGNS LIST

1 pet pad, 3 top sheet (nonwoven fabric), 3*t* groove, 3*p* protrusion,
3*h* through hole, 4 absorbent body, 4*c* absorbent core, 4*t* cover sheet, 5 back sheet, 10 bulkiness recovery apparatus, 11 heating unit, 12*a* to 12*e* conveying roller (deformation mechanism), 13 hot-air source, 131 fan, 132 heater, 14 hot-air duct,
15*a* to 15*d* conveyor space, 16*a* to 16*d* jet inlet, 17*a* to 17*d* evacuation opening,
18 circulating duct, C1 hot-air chamber, C2 reclaiming chamber,
30 first case member (case unit), 31 base member, 32 first cover member, 33 second cover member, 34 side plate, 35 side plate, 40 second case member (case unit), 41 base member, 42 first cover member, 43 second cover member, 50 bulkiness recovery apparatus,
60 first case member (case unit), 61 base member, 62 first cover member,
70 second case member (case unit), 71 base member, 72 first cover member,
73 second cover member, 80 third case member (case unit), 81 base member,
82 first cover member,

The invention claimed is:

1. An apparatus for recovering bulkiness of a nonwoven fabric by blowing hot air to heat the nonwoven fabric, the apparatus comprising:
a heating mechanism including a case unit, a jet inlet and an evacuation opening,
wherein
the case unit has a conveyor space in which the nonwoven fabric is conveyed,
the case unit has first and second sides opposing each other in a conveying direction in which the nonwoven fabric is conveyed inside the conveyor space,
the jet inlet is configured to blast the hot air into the conveyor space from the first side toward the second side in the conveying direction and to blast the hot air along the conveying direction while the hot air is in contact with either one of two surfaces of the nonwoven fabric, and
the evacuation opening is configured to evacuate the hot air from the conveyor space; and
a deformation mechanism configured to deform the nonwoven fabric discharged from the case unit to cause the one surface of the nonwoven fabric to be convex,
wherein
the case unit includes
a base member,
a first cover member facing a lower surface of the base member with spacing therebetween,
a second cover member facing an upper surface of the base member with spacing therebetween, and
a pair of side plates facing each other in a cross direction crossing the conveying direction and in a width direction of the nonwoven fabric,
the conveyor space has
a first conveyor space partitioned by the lower surface of the base member, an upper surface of the first cover member, and the pair of side plates, and
a second conveyor space partitioned by the upper surface of the base member, a lower surface of the second cover member, and the pair of side plates, and
the jet inlet has
a first jet inlet including a first slit on the lower surface of the base member, and
a second jet inlet including a second slit on the upper surface of the base member.

2. The apparatus according to claim 1, wherein
the deformation mechanism is configured to deform the nonwoven fabric that is being spontaneously cooled outside the case unit.

3. The apparatus according to claim 1, wherein
the deformation mechanism is a conveying roller configured to convey the nonwoven fabric by winding the nonwoven fabric around the conveying roller.

4. The apparatus according to claim 1, further comprising a further heating mechanism configured to reheat the nonwoven fabric that has passed the deformation mechanism.

5. The apparatus according to claim 4, wherein
the conveyor space of the heating mechanism and a conveyor space of the further heating mechanism are aligned in a direction intersecting the conveying direction, and
the deformation mechanism is a conveying roller configured to reverse the nonwoven fabric while conveying the nonwoven fabric by winding the nonwoven fabric around the conveying roller, and transferring the nonwoven fabric, which has passed the conveyor space of the heating mechanism, to the conveyor space of the further heating mechanism.

6. The apparatus according to claim 1, wherein the first and second conveyor spaces are arranged side by side in an up-down direction intersecting the conveying direction and the cross direction.

7. The apparatus according to claim 6, wherein
the base member includes
an upper-surface member defining the upper surface of the base member, and
a lower-surface member opposing the upper-surface member in the up-down direction, and defining the lower surface of the base member,
the upper-surface member has an end portion bent toward the lower-surface member and extending inside the base member, and
the lower-surface member has an end portion bent toward the upper-surface member and extending inside the base member.

8. The apparatus according to claim 7, wherein the base member further includes
a further upper-surface member spaced away from the end portion of the upper-surface member and also defining the upper surface of the base member, the further upper-surface member and the end portion of the upper-surface member forming the second jet inlet configured to blast the hot air into the second conveyor space, and
a further lower-surface member spaced away from the end portion of the lower-surface member and also defining the lower surface of the base member, the further lower-surface member and the end portion of the lower surface member forming the first jet inlet configured to blast the hot air into the first conveyor space.

9. The apparatus according to claim 7, wherein the end portion of the upper-surface member has a surface extending obliquely from an upstream side toward an downstream side in the conveying direction.

10. The apparatus according to claim 1, wherein the base member forms the first and second jet inlets, the first jet inlet is configured to blast the hot air into the first conveyor space from an upstream side to a downstream side in the conveying direction of the nonwoven fabric, and the second jet inlet is configured to blast the hot air into the second conveyor space from the upstream side to the downstream side in the conveying direction of the nonwoven fabric.

11. The apparatus according to claim 1, wherein the heating mechanism is configured to supply, at the jet inlet, the hot air of a temperature which is lower than a melting point of a thermoplastic resin fiber contained in the nonwoven fabric, and equal to or higher than a temperature of 50° C. below the melting point of the thermoplastic resin fiber.

12. The apparatus according to claim 10, wherein the first and second jet inlets formed by the base member are configured to blast the hot air in the conveying direction of the nonwoven fabric at an acute angle to the one surface of the nonwoven fabric which is in contact with the hot air, and the acute angle is in a range of 0° to 30°.

13. A method of recovering bulkiness of a nonwoven fabric by blowing hot air to heat the nonwoven fabric, the method comprising:

heating the nonwoven fabric by blasting the hot air into a conveyor space of a case unit, wherein the case unit has first and second sides opposing each other in a conveying direction in which the nonwoven fabric is conveyed inside the conveyor space, and the hot air is blasted from the first side toward the second side in the conveying direction;

flowing the hot air along the conveying direction while being in contact with either one of two surfaces of the nonwoven fabric; and deforming the nonwoven fabric discharged from the case unit to cause the one surface of the nonwoven fabric to be convex, wherein the case unit includes a base member, a first cover member facing a lower surface of the base member with spacing therebetween, a second cover member facing an upper surface of the base member with spacing therebetween, and a pair of side plates facing each other in a cross direction crossing the conveying direction and in a width direction of the nonwoven fabric, the conveyor space has a first conveyor space partitioned by the lower surface of the base member, an upper surface of the first cover member, and the pair of side plates, and a second conveyor space partitioned by the upper surface of the base member, a lower surface of the second cover member, and the pair of side plates, and the jet inlet has a first jet inlet including a first slit on the lower surface of the base member, and a second jet inlet including a second slit on the upper surface of the base member.

14. The method according to claim 13, wherein the heating mechanism supplies, at the jet inlet, the hot air of a temperature which is lower than a melting point of a thermoplastic resin fiber contained in the nonwoven fabric, and equal to or higher than a temperature of 50° C. below the melting point of the thermoplastic resin fiber.

15. The method according to claim 13, wherein the base member forms the first and second jet inlets, the first jet inlet blasts the hot air into the first conveyor space from an upstream side to a downstream side in the conveying direction of the nonwoven fabric, the second jet inlet blasts the hot air into the second conveyor space from the upstream side to the downstream side in the conveying direction of the nonwoven fabric, the first and second jet inlets formed by the base member blast the hot air in the conveying direction of the nonwoven fabric at an acute angle to the one surface of the nonwoven fabric which is in contact with the hot air, and the acute angle is in a range of 0° to 30°.

* * * * *